United States Patent [19]

Dundas

[11] 4,189,791

[45] Feb. 26, 1980

[54] SWIMMING POOL HEATING AND COOLING SYSTEM

[76] Inventor: Gifford W. Dundas, Box 735, Lewiston, Id. 83501

[21] Appl. No.: 1,066

[22] Filed: Jan. 5, 1979

[51] Int. Cl.[2] ..... E04H 3/16; E04H 3/18

[52] U.S. Cl. ..... 4/172; 4/172.15; 126/417

[58] Field of Search ..... 4/172.15, 172, 172.12; 126/270, 271

[56] References Cited

U.S. PATENT DOCUMENTS

| | | | |
|---|---|---|---|
| 3,022,781 | 2/1962 | Andrassy | 4/172.15 X |
| 3,411,163 | 11/1968 | Myers, Jr. | 4/172 |
| 3,453,666 | 7/1969 | Hedges | 4/172 |
| 3,616,468 | 11/1971 | Takacs | 4/172.15 |
| 3,926,008 | 12/1975 | Webber | 4/172 |
| 4,153,955 | 5/1979 | Hinterberger | 4/172.15 |

FOREIGN PATENT DOCUMENTS

| | | | |
|---|---|---|---|
| 10865 | of 1904 | United Kingdom | 4/172.15 |

*Primary Examiner*—Henry K. Artis
*Attorney, Agent, or Firm*—Wells, St. John & Roberts

[57] ABSTRACT

An apparatus is described for heating or cooling water in swimming pools. The apparatus takes ambient air and pumps it through a submerged, perforated manifold tube. Heat is exchanged between the air bubbles and water as the bubbles ascend to the pool surface. Operational control is maintained through a pair of thermostatic switches. A sensor is situated within the water to detect the water temperature and another sensor is exposed to the atmosphere for detecting the ambient air temperature. A control operatively connects the sensors and operates in response to variations in the temperature differential between the air temperature and the water temperature to activate or deactivate the air pump. The control is adjustable, enabling the user to select a desirable operational range for the air pump and thereby control the temperature of the water in his pool. When the ambient air temperature reaches a prescribed value, a switch is operated to activate the air pump. When the water becomes heated to a prescribed value, another switch is operated to deactivate the air pump. The pool water may also be cooled by pumping cool ambient air through the manifold tube. The switching modes normally used for operating the pump are reversed for cooling the water so the pump will be activated when the ambient air drops below a prescribed temperature and deactivated when the water temperature drops below a prescribed level.

7 Claims, 4 Drawing Figures

SWIMMING POOL HEATING AND COOLING SYSTEM

BACKGROUND OF THE INVENTION

The present invention is related to systems for heating and cooling swimming pools.

A problem arises in warm climates, especially where evenings remain warm, with the water in swimming pools becoming uncomfortably warm for swimming. Refrigeration requires substantial use of energy and water is wasted if the pool has to be drained and refilled.

It is also an expensive luxury to provide a heated swimming pool in cooler climates, especially when the pool is to be heated by electricity or fossil fuel. The problem therefore is to obtain some system by which the water within a swimming pool may be heated without incurring the waste and expense involved in the previously known methods. Solar heat has been utilized in response to this problem. Light absorbent pool covers have been developed that are spread over the surface of the swimming pool. They will catch the sun's rays and heat the water beneath the cover surface. This system is serviceable but cannot be used when the pool is to be used nor can the cover be easily and quickly placed and removed from the pool surface.

Another problem area with swimming pools is accumulation of debris within the pool and on the pool walls. Conventional "skimmers" are serviceable for collecting floating debris but are ineffective in cleaning the pool walls. Usually the only way pool walls can be effectively cleaned is to drain the pool and physically scrub the walls. This necessitates re-heating of the fresh water and thus involves more wasted energy.

It therefore becomes desirable to obtain a system that will heat or cool swimming pool water using minimal energy and that will also facilitate cleaning of the pool walls.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
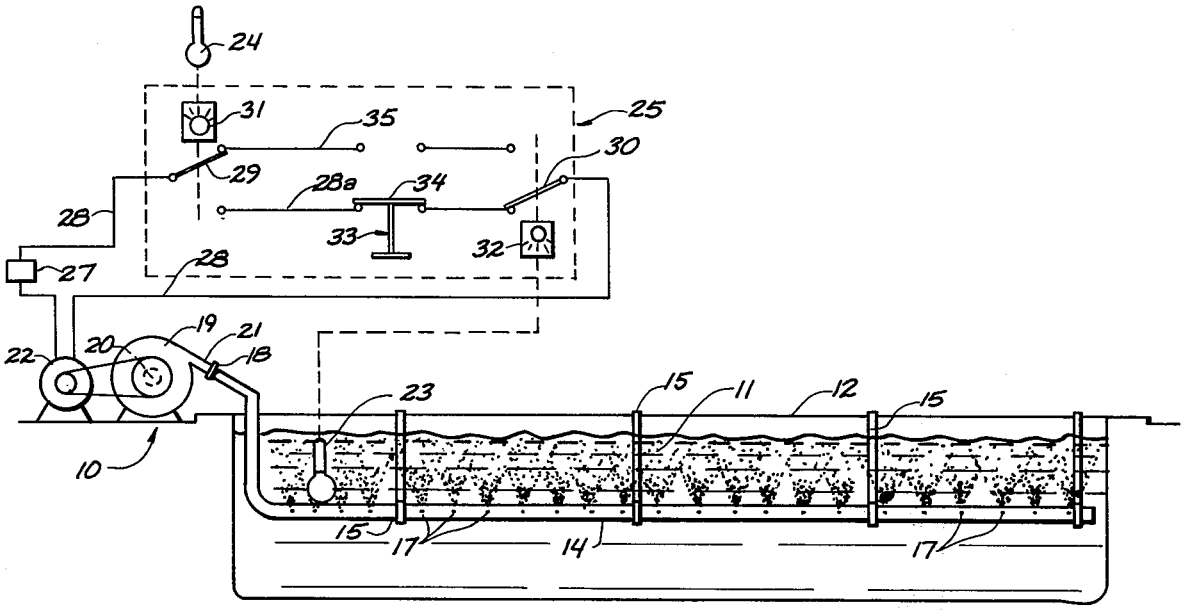
FIG. 1 is a diagrammatic view of the invention and associated circuitry.

A preferred form of the present apparatus is generally designated at 10 in the accompanying drawings. It is intended that the apparatus 10 be utilized to heat water 11 of conventional outdoor swimming pool 12.

The apparatus includes an elongated air delivery manifold tube 14 that may be mounted to a base 15. The tube 14 is preferably supported along the pool walls. It may extend about the entire pool periphery or along one or more walls thereof. The tube is provided with a number of perforations 17 along a length thereof that is to be submerged in the pool 12. Tube 14 also includes an open end 18 that is connected to an air pump 19.

Figure 4:
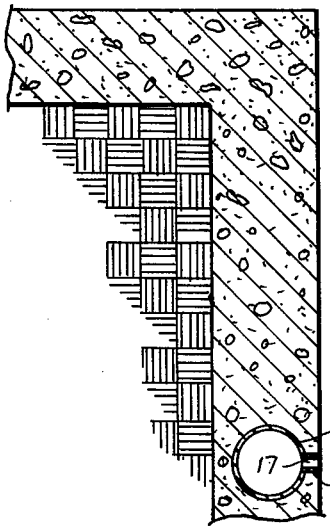
FIG. 4 is a view showing the manifold tube of my invention embedded in a pool wall.

FIG. 4 shows the tube 14 formed or embedded within a pool wall. This eliminates the need for a base 15 and puts the tube 14 into contact with the ground preferably at a level below the frost line. Radial spouts 16 are fitted to the tube 14 in open communication with the perforations 17. They lead to outward ends that may be flush with the pool wall to openly communicate with the water therein.

The air pump 19 as shown, is preferably a centrifugal type blower having a radial intake 20 and tangential discharge 21. The open tube end 18 is connected to the discharge 21. The air pump 19 may be powered by an electric motor 22 and appropriate drive linkage. It is to be noted that the preferred form of pump is illustrated and described as being a centrifugal form of blower. However, it is entirely conceivable that other forms of blowers or pumps may be utilized for supplying air under pressure to the manifold tube 14.

An important feature of the present invention is diagrammatically illustrated in FIG. 1 in the form of sensing and control apparatus for automatically controlling operation of the air pump 19 in response to temperature differential between the ambient air and water 11.

An appropriate temperature sensing means 23 is submerged below the surface of the water 11 for sensing the water temperature. A similar air temperature sensing means is shown at 24 for detecting the ambient air temperature. The water and air temperature sensing means 23 and 24 are operatively connected to a control means 25.

The control means 25 is designed to activate the air pump when the temperature differential between the ambient air and water 11 reaches a first prescribed value and for deactivating the air pump when the temperature differential reaches a second prescribed value.

Specifically, the control means 25 is connected to a power source 27 such as typical household current through two main branches of a circuit 28. A first selectively controllable and thermostatic switch 29 is provided within the control means 25. It is connected in series with a second similar switch 30. In releation to the circuit 28, the first switch 29 is a double pole switch and is normally open. The second switch 30 is also double pole but is normally closed.

A first switch control 3l is provided to enable manual selection of the ambient air temperature at which the switch 29 will be moved from one pole to the other. A second control 32 operatively interconnects the water temperature sensing means 24 and switch 30 to enable an operator to selectively determine the value at which switch 30 will be operated.

Basically the switches 29 and 30 may be single pole, single throw switches connected in series in a simple circuit where only one operational mode is desired for each switch. The circuit shown, however, shows double pole switches 29 and 30 along with an intermediate switch mode control means 33.

The switch mode control means 33 may be simply comprised of a double pole selector switch 34 that is normally closed in a branch **28*a* with the circuit 28. However, a mode reversing circuit branch 35 is provided whereby the function of switches 29 and 30 can be reversed. The apparatus may therefore be utilized to heat or to cool the water 11**, depending upon the preference of the operator.

The apparatus may be installed simply by locating the air pump 19 at a convenient location adjacent to a pool 12. The manifold tube 14 is then connected to the discharge 21 of the air pump and the perforated portion of the tube 14 is submerged along one or more side walls of the pool 12. It is preferable that the manifold tube perforations 17 extend at least the full length or width of the pool. The depth that the manifold can be placed under the water depends on the air pressure developed by the pump. The size of the air outlet holes in the tube and the spacing, also depend on the volume and pressure that the air pump can produce. The base 15 is attached to the pool side to submerge the tube 14 and position it below the water surface.

If the pool is under construction, the tube can be embedded directly in the pool wall with the spouts 16 leading to the wall surface. It is preferred that the tube be situated below frost level.

The water temperature sensing means 23 is also submerged below the surface of the pool. This may be accomplished simultaneously with submerging of the manifold tube if the sensing means is connected to the tube 14. The circuit 28 is then connected to a convenient source 27 of electrical energy.

The switches 29 and 30 and mode control means 33 are set as shown in FIG. 1 for normal operation to heat the pool water 11. Prior to operation the user may set the first and second controls 31, 32 to determine the operational range of temperatures in which the air pump will function. For the purpose of present explanation, let us assume the operator has set the first control 31 at 75° and the second control 32 at 70° F. When the ambient air temperature reaches 75° the control will cause switch 29 to close, completing the circuit and activating the air pump 19 (providing the water temperature is below 70°). The warm air is drawn through the pump intake 20 and forced through the discharge 21 and into manifold tube 14. The warm air passes through the tube and eventually out through the perforations 17 into the water 11. Heat dissipates into the water from the rising warm air bubbles.

When the pool temperature is elevated above 70° F., the normally closed switch 30 will open and break the circuit. Subsequently if the water temperature drops below 70° F., the switch 30 will again close and complete the circuit, providing the ambient air temperature is greater than 75°. If not, the circuit will remain open.

In some locations it is not uncommon for the pool water to become uncomfortably warm and it becomes desirable to lower the water temperature. In such situations, the mode control means 33 is useful to reverse the roles of switches 29 and 30. The selector switch 34 is operated to complete the circuit branch 35 through the normally unused poles of switches 29 and 30. The complementary branch 28*a* of circuit 28 is thereby opened. This reverses operation of the switches 29 and 30 since switch 30 is now normally open and switch 29 is normally closed. The controls 31 and 32 may be reset so that control 32, for example, is set at 70° and 31 is set at 65°. If the water temperature is greater than 70°, the switch 30 will be activated and move from its normally open mode to a closed mode. This will complete a circuit through the normally closed switch 29, providing the ambient air temperature is 65° or below. When the ambient air temperature raises above 65°, the switch 29 will be actuated to open the circuit and deactuate the air pump 19.

When the apparatus is being utilized to cool water 11 the air bubbles escaping through the perforations 17 are composed of air that is at a lower temperature than the surrounding water. Heat from the water will be absorbed in the air bubbles and released into the atmosphere as the bubbles reach the water surface. The temperature of the water within the pool will thereby be lowered. When the temperature drops below the preselected value (70°) the switch 30 will automatically open and break the circuit to the air pump motor 22.

Figure 2:
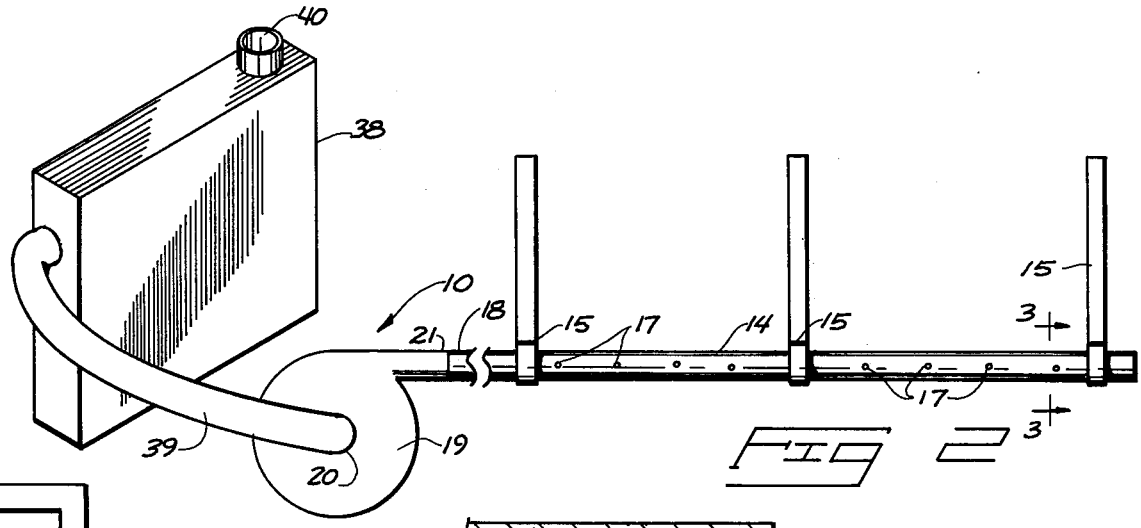
FIG. 2 is a view of the present apparatus connected to a solar panel for heating intake air.
Figure 3:
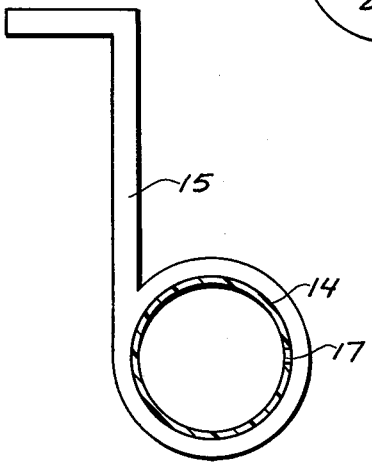
FIG. 3 is an enlarged section view taken substantially along line 3—3 in FIG. 2.

In cooler climates, it may be desirable to provide a solar collector as shown at 38 in FIG. 2. The collector 39 may be one of a standard form currently used for the purpose of heating ambient air. A flex hose 39 is provided opening into the collector 38 and the intake 20 of the air pump 19. Ambient air may enter the collector at 40 and be circulated therethrough prior to delivery to the intake 20 of air pump 19. In this arrangement, it is preferred that the air temperature sensing means 24 be situated within the solar collector 38. In this manner the air pump will be operated when the heated air in the solar collector exceeds the minimum value. Additionally, it may be desirable to activate the air pump when the air temperature exceeds the water temperature by a desired differential such as 10 degrees F. and to deactivate the air pump when the water temperature is within a few degrees of the air temperature.

It may be desirable to manually operate the system even in subfreezing weather to blow air into the water to circulate the water and draw the warmer water near the bottom upward to prevent ice from forming.

This system is adaptable to varying size and shape pools. The air may be emitted from the side or bottom or may be emitted by a floating manifold apparatus. The important aspect is that the air be bubbled through the water to transfer heat between the air and water.

It has been my experience that the present invention is effective both in heating the water 11 and for keeping the water clean. The raising air bubbles keep the water within the pool circulating and will circulate debris loosened by the air bubbles toward a pool skimmer or other cleaning device. If the tube is situated adjacent to a wall of the pool, the raising bubbles will clean the adjacent wall. Of course, the water is also aerated by the raising bubbles.

It is to be understood that the above description is given merely by way of example to set forth a preferred form of the present invention. It is understood that other forms of the invention may be envisioned without deviating from the scope of my invention. Therefore, only the following claims are to be taken as restrictions upon the scope of my invention.

What I claim is:

1. Apparatus for heating or cooling water in a swimming pool, comprising:

a powered air pump having an air intake and a forced air discharge;

an air delivery manifold tube having an open end attached to the forced air discharge of said pump and adapted to be submerged within the pool;

a plurality of perforations formed through the tube for allowing escape of air;

air temperature sensing means for sensing ambient air temperature;

water temperature sensing means for sensing the water temperature within the pool;

control means operatively connecting the air temperature sensing means and water temperature sensing means for activating the powered air pump when the temperature differential between the ambient air and water in the pool reaches a first prescribed value and for deactivating the powered air pump when the temperature differential between the air and water in the pool reaches a second prescribed value.

2. The apparatus as set out by claim 1 wherein the powered air pump is electrical and wherein the air and water temperature sensors are operatively connected to first and second selectively controllable thermostatic switches operatively connected in series with the electrically powered air pump;

with a first thermostatic switch being set to a normally closed mode and a second thermostatic switch set to a normally open mode.

3. The apparatus as set out by claim 2 wherein the first and second thermostatic switches are selectively adjustable.

4. The apparatus as set out by claim 2 further comprising:

solar heating means selectively connectable to the air intake of the pump for preheating air prior to delivery to the pump through its air intake.

5. The apparatus as set out by claim 2 further comprising thermostatic switch mode control means for selectively reversing the modes of the first and second thermostatic switches such that the apparatus may be operated in one mode to heat a pool or in the other mode to cool the pool.

6. The apparatus as set out by claim 1 further comprising a base on the air delivery manifold tube adapted to submerge and support the tube below the surface of the water.

7. The apparatus as set out by claim 1 further comprising hollow spouts attached to the manifold tube in open communication with the perforations therein, the spouts extending outward from the manifold tube so that the manifold tube can be embedded in a wall of a swimming pool during construction thereof, with the spouts leading from the tube to openly communicate with water in the pool.

* * * * *